US007735701B2

(12) United States Patent
Eberle

(10) Patent No.: US 7,735,701 B2
(45) Date of Patent: Jun. 15, 2010

(54) BACKPACK FOR CARRYING WEAPONS

(76) Inventor: Glen Richard Eberle, 2410 Hillway Dr., Boise, ID (US) 83702

( * ) Notice: Subject to any disclaimer, the term of this patent is extended or adjusted under 35 U.S.C. 154(b) by 993 days.

(21) Appl. No.: 11/318,212

(22) Filed: Dec. 23, 2005

(65) Prior Publication Data

US 2007/0145092 A1 Jun. 28, 2007

(51) Int. Cl.
*A45F 3/04* (2006.01)
*A45F 3/06* (2006.01)

(52) U.S. Cl. ..... 224/149; 224/650; 224/652; 224/637; 224/913; 224/916

(58) Field of Classification Search ..... 224/149, 224/150, 640, 647, 650–652, 193, 637, 639, 224/913, 916, 917, 190
See application file for complete search history.

(56) References Cited

U.S. PATENT DOCUMENTS

| | | | | |
|---|---|---|---|---|
| 2,884,172 | A * | 4/1959 | Kubo | 224/149 |
| 3,973,776 | A | 8/1976 | Ogle | |
| 4,057,180 | A | 11/1977 | Whitaker | |
| 4,754,904 | A | 7/1988 | Fischer et al. | |
| 4,817,835 | A | 4/1989 | Tarr, Jr. | |
| 4,819,844 | A | 4/1989 | Niemela | |
| 4,823,998 | A | 4/1989 | Johnson | |
| 4,903,875 | A | 2/1990 | Smart et al. | |
| 4,964,553 | A | 10/1990 | Glynn | |
| 5,029,741 | A | 7/1991 | Easter | |
| 5,184,764 | A * | 2/1993 | Orovan et al. | 224/636 |
| 5,325,618 | A | 7/1994 | Turner | |
| 5,386,932 | A | 2/1995 | Gross | |
| 5,400,935 | A | 3/1995 | Farmer | |
| 5,464,136 | A | 11/1995 | Eddy | |
| 5,664,721 | A | 9/1997 | Homeyer | |
| 5,669,170 | A | 9/1997 | Norris | |
| 5,724,707 | A | 3/1998 | Kirk et al. | |
| 5,941,434 | A | 8/1999 | Green | |
| 6,260,748 | B1 * | 7/2001 | Lindsey | 224/150 |
| 6,290,114 | B1 * | 9/2001 | Berberian | 224/642 |
| 6,431,424 | B1 | 8/2002 | Smith | |
| 6,619,519 | B1 | 9/2003 | Nix et al. | |
| 6,763,987 | B1 | 7/2004 | Eberle | |

* cited by examiner

*Primary Examiner*—Nathan J Newhouse
*Assistant Examiner*—Adam Waggenspack
(74) *Attorney, Agent, or Firm*—Robert L. Shaver; Dykas, Shaver & Nipper, LLP

(57) ABSTRACT

A backpack with a receptacle and a tether has been devised whereby the user has a convenient place for the storage and carriage of a weapon, such as an archery bow or a long gun firearm. The backpack has the advantage of allowing the removal of the weapon from the backpack without first removing the pack from the user's back. It is equipped with at least one shoulder strap. In an ideal embodiment, a waist belt is included to facilitate the stabilization of the backpack, as well as to contribute to the load bearing functions of the backpack.

14 Claims, 6 Drawing Sheets

BACKPACK FOR CARRYING WEAPONS

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

The present invention relates to backpacks. In particular, the present invention relates to a backpack which has the utility of carrying a weapon, such as an archery bow or a long gun firearm, and furthermore allows rapid access to and use of these weapons without removal of the backpack from the user's back. This capability is useful for the activity of hunting, wherein a hunter will often be carrying a backpack filled with the sundries necessary to the outing, and simultaneously carrying an archery bow and/or a long gun. These weapons are often long, bulky, heavy, and awkward to carry, and are an encumbrance to activity. It can readily be imagined that, whereas it is desirable to move quietly while hunting, the physical characteristics of an archery bow or a long gun make this difficult, particularly in the vicinity of brush, tree branches, or the like. Carrying one's firearm or archery bow behind one's body is an advantage, because the body shields the weapon from potential conflicts with passing obstacles. It is further presented that for purposes of safety as well as for the purpose of the protection of valuable weapons while actively hiking while hunting, it is necessary and beneficial to have the weapon carried in a convenient and out of the way location whereby passing branches won't protrude into the sighting mechanism, trigger housing, or other sensitive parts, and also won't be permitted to scratch and mar the finish of the weapon. In the activity of hunting, the participant often wears a backpack for the transport of various articles, and therefore the best potential method for carriage of a firearm or archery bow is on the backpack. There have been attempts to address this desired objective, with varying degrees of success. A common handicap in the prior art is that the mechanisms devised for attaching a weapon to a backpack generally require the removal of the backpack from the wearer's back in order to attach or detach the weapon from its carriage. In hunting, it is frequently necessary to have quick and ready access to one's weapon, and typical backpacks of the prior art do not facilitate this.

There is a long history and variety of backpacks and related devices for carriage of loads upon the human back, and the prior art is widely explored, known, and developed. Their size and dimension ranges from a small, compact variety known as daypacks, such as disclosed in U.S. Pat. No. 5,573,166 to Leja, to larger backpacks designed for carrying heavier and more bulky loads such as disclosed in U.S. Pat. No. 6,179,188 to Gleason. While it is conceivable to strap an archery bow or long gun weapon to these, they are generally not well suited to the task, and a number of specialized straps would in most instances be required.

There is similarly a long and varied history of means and mechanisms for carriage of personal weapons, some of which include some type of backpack-based storage. Most often, a variety of straps are used to attach an archery bow or long gun firearm to the outer surface of a backpack in a removably fixed position, and make no provision for quickly detaching the weapon from the backpack. In fact, most prior art systems require the removal of the pack from the wearer's back to gain access to the weapon, or the assistance of a second person in doing so. It has been discovered in the art that, in order to protect and support the bulk of a compound archery bow, it is helpful to have a pocket on a backpack that cradles the bottom of the bow. Such a backpack is disclosed by U.S. Pat. No. 5,664,721 by Homeyer. This concept bears a limitation in that it does not provide a means for the wearer to get the archery bow off of the backpack without assistance, or without removing the backpack and manipulating a plurality of straps. If used with a long gun firearm, it is meant to be retained on the firearm while it is being fired. It further makes no provision for the carriage of sundry items in a backpack. U.S. Pat. No. 6,431,424 as disclosed by Smith provides a device for carrying a weapon where a user will have access to it, but this device has the disadvantage of placing the weapon forward of the user's shoulders, where it can be an encumbrance to the wearer's activity. U.S. Pat. No. 6,763,987 as disclosed by Eberle provides a long pocket or scabbard for the carriage of a long gun. While excellent in its application, a disadvantage of this configuration is that the dimension of the scabbard often dictates the dimension of the surrounding backpack, resulting in a lack of flexibility in the layout and design of the backpack. Furthermore, a scabbard sized to fit one long gun may not fit another, and a gun-sized scabbard will not be suitable to carry an archery bow. A more universal system, which can be applied to conventional backpacks and which can removably carry a variety of weapons, will in many cases be desirable.

In outdoor activities that involve the use of a weapon, participants frequently range far afield on foot, and often desire to carry an array of goods necessary to the outing in a backpack. These goods can include camping gear, survival equipment, inclement weather gear, water, food, ammunition, and the like. This gear and these backpacks can be quite bulky, and by themselves can be difficult to manage. When carrying a bulky weapon in addition to the backpack, it is advantageous to add it to the load of the backpack rather than carry it separately. It can further be imagined that when climbing hills, passing through thick brush, and the like, the use of both hands is desirable, and that for reasons of safety, convenience, and the relief of fatigue, it is desirable to stow one's weapon in a place that keeps it safe and out of the way, but still maintains it in a ready position in the event that its use is unexpectedly required. It is submitted that the present invention substantially meets these needs, that it is a new, original, and unique departure from the prior art, and that it will be embraced with enthusiasm by those who have reason to carry heavy or bulky weapons while they hike about on their feet.

BRIEF SUMMARY OF THE INVENTION

The present invention is a backpack which is capable of carrying an archery bow or long gun type of weapon, and which provides a solution to the problem of where to stow bulky or heavy weapons on one's person while traveling afoot. A primary object of the invention is to present a backpack which permits the removal of the weapon by the wearer of the backpack, without removing the backpack from one's body. In its simplest embodiment, the backpack can be reduced to a shoulder-mounted sling with a cradle on the backside, combined with a releasable tether that is accessible from the front side. A secondary object of the present preferred embodiment of the invention is to present a backpack of dual utility, which will be capable of carrying significant loads of cargo and simultaneously will accommodate the aforementioned carriage and self-removability of a heavy or bulky weapon. More specifically, a backpack is presented which has at least one shoulder strap which extends from the top of the backpack forward over the shoulders of a user, and then returns on either side of the waist to reattach at the lower part of the backpack. In the preferred embodiment, two of these straps are used, as is common in the prior art. These are padded on their upper portion in order to make the backpack more comfortable for the wearer, and include fittings which make them adjustable in length. Also in the preferred embodiment, a waist belt is included for the dual purposes of adding to the load bearing capabilities of the backpack, and to stabilize its lower portion in order to facilitate the rapid withdrawal of a weapon from the weapon carrying device. Preferably, this waist belt is of heavy-duty construction, is padded for comfort, is wide nearest the main panel of the backpack, and tapers in a symmetrical fashion as it develops forward toward an adjustable and releasable closure.

The portion of the backpack which will be worn on the user's back includes a receptacle in the form of a pocket with an open top which is fitted to receive one end of a bulky weapon. The weapon rests in this receptacle by force of gravity.

A tether with a release mechanism is provided, said tether passing from its attachment on the forward portion of the backpack to loop around or otherwise engage the weapon to be carried. This tether is used to hold the upper end of the weapon, as it is being carried, against the backpack and/or wearer's shoulders, and in combination with the open topped receptacle holds the weapon to the backpack. In order to remove the weapon from the backpack, the wearer grasps the weapon with one hand, and with the other hand releases the release mechanism. The weapon can then readily be pulled free of the backpack while it is still being worn, and used without interference there from.

A storage compartment on a preferred embodiment is generally comprised of a six sided, box type construction, formed to encompass a volume of space, this enclosed space being intended for the storage of sundries. The compartment is made of nylon fabric or the like, has an orifice with a zipper, clasp, or like closure, and is similar to conventional cargo compartments on backpacks of the prior art. There may be more than one of these described standard cargo compartments, and these may be further internally subdivided, with provision made for individual access to, and selective closure for, each of the storage cells thereby formed, without substantially altering the intent or scope of the invention. It can similarly be seen that the size and orientation of the cargo compartments can be varied and altered in the manner common to load bearing backpacks in the prior art, without substantially altering the intent or scope of the invention.

The advantages of this invention over the prior art arise from the fact that it provides for the convenient carriage of a large, heavy, or bulky weapon on the human back, and permits the wearer to remove the weapon from its carriage location in an unassisted manner without first removing the backpack from his back. This improved accessibility permits more rapid access to, and use of, a weapon being carried upon one's back than other carriers in the prior art. A secondary advantage over the prior art is that this backpack is intended to be of full and simultaneous use both as a cargo carrying backpack, and as a device for safely, efficiently, comfortably, and conveniently carrying a long gun or archery bow. Furthermore, it is intended to be of use to one who is actively engaged in hiking while carrying a weapon, thereby leaving both hands, at least one of which would otherwise be holding or stabilizing a weapon, free to assist in balance, climbing, holding away branches, and the like. Lastly, by housing the weapon aft of one's shoulders, there will be improvements in the protection of the weapon, and safety advantages in having sensitive components such as the trigger, gun safety, sighting, and firing mechanisms shielded by one's body while one is traveling through and about protruding branches and the like.

It is presented that one reason that examples similar to this invention are not found in the prior art is because the mechanical and physical proportions of the present invention are not obvious. The preferred embodiment offers a dual utility backpack, which serves all of the functions of a standard backpack and has the added benefits and conveniences resulting from the careful incorporation of a self-removable weapons carriage system. It can be seen that the present invention is an entirely unique, new, and useful departure from all that has been accomplished in the prior art.

DETAILED DESCRIPTION OF THE INVENTION

Figure 1:
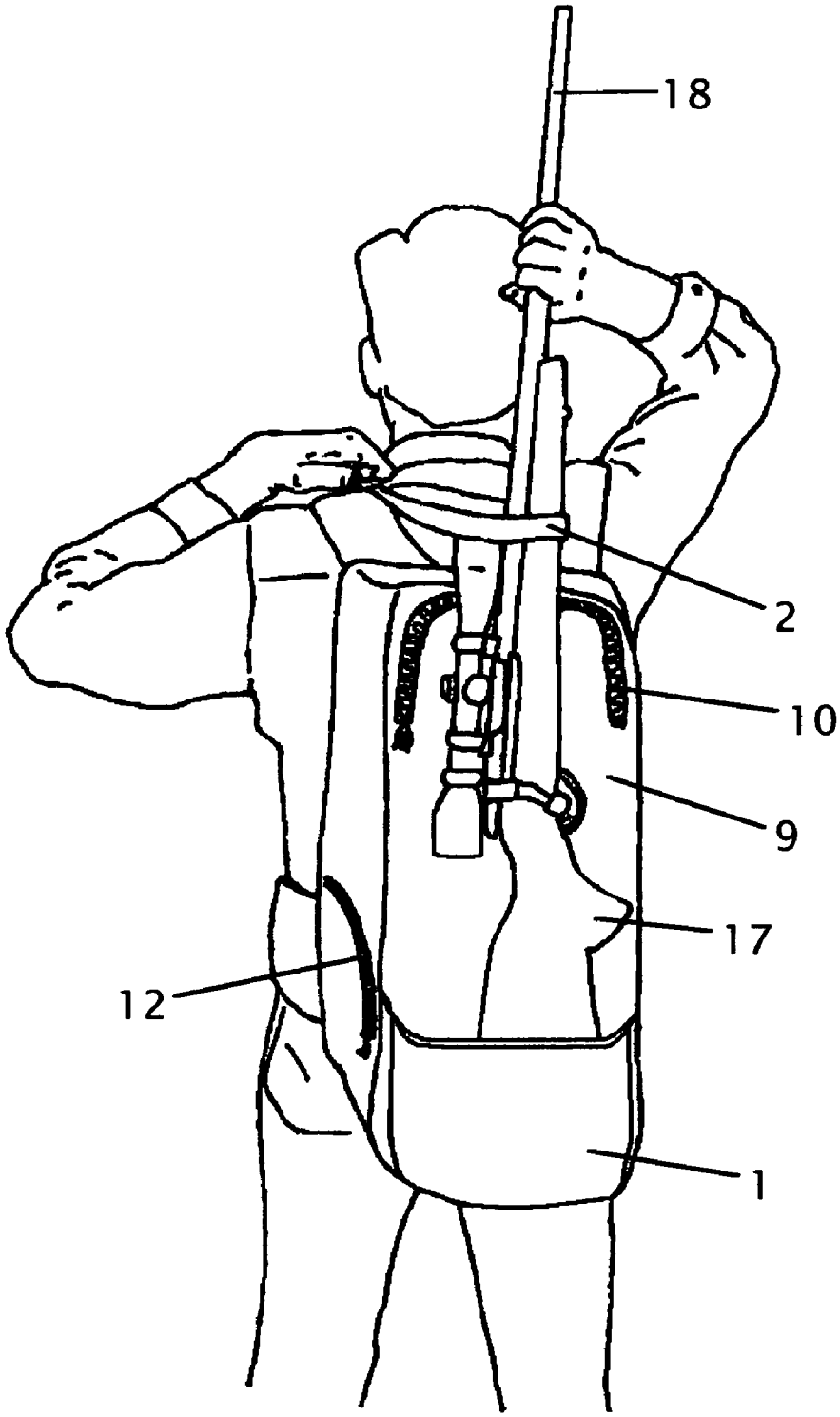
FIG. 1 is a view of the aft side of the invention, showing a user removing scoped rifle.
Figure 5:
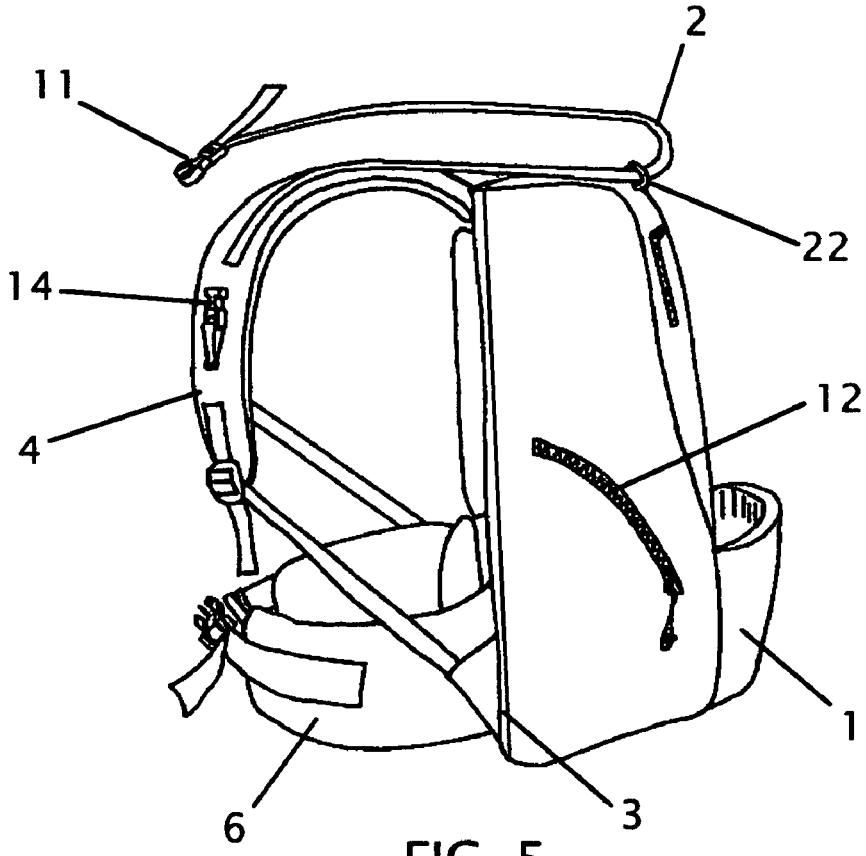
FIG. 5 is a left profile view of the invention.
Figure 6:
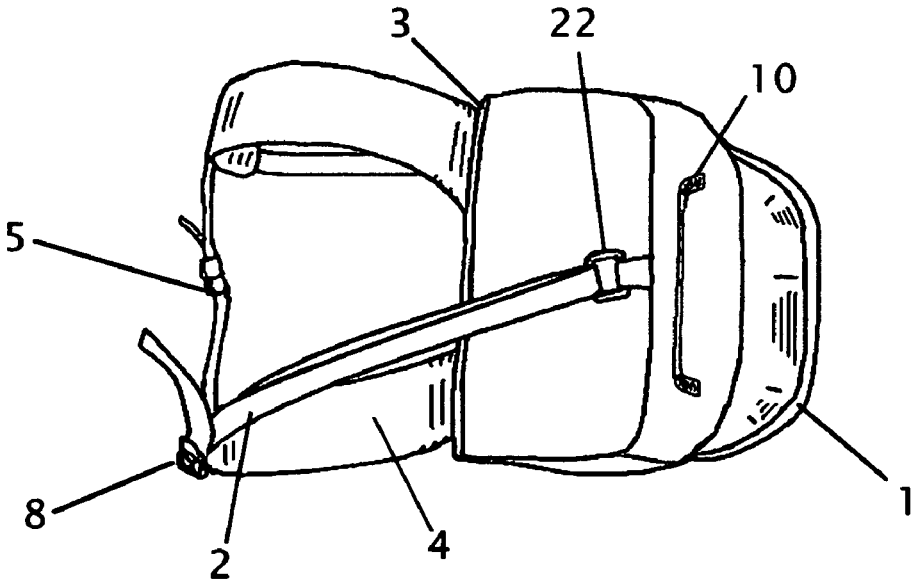
FIG. 6 is a top view of the invention.
Figure 7:
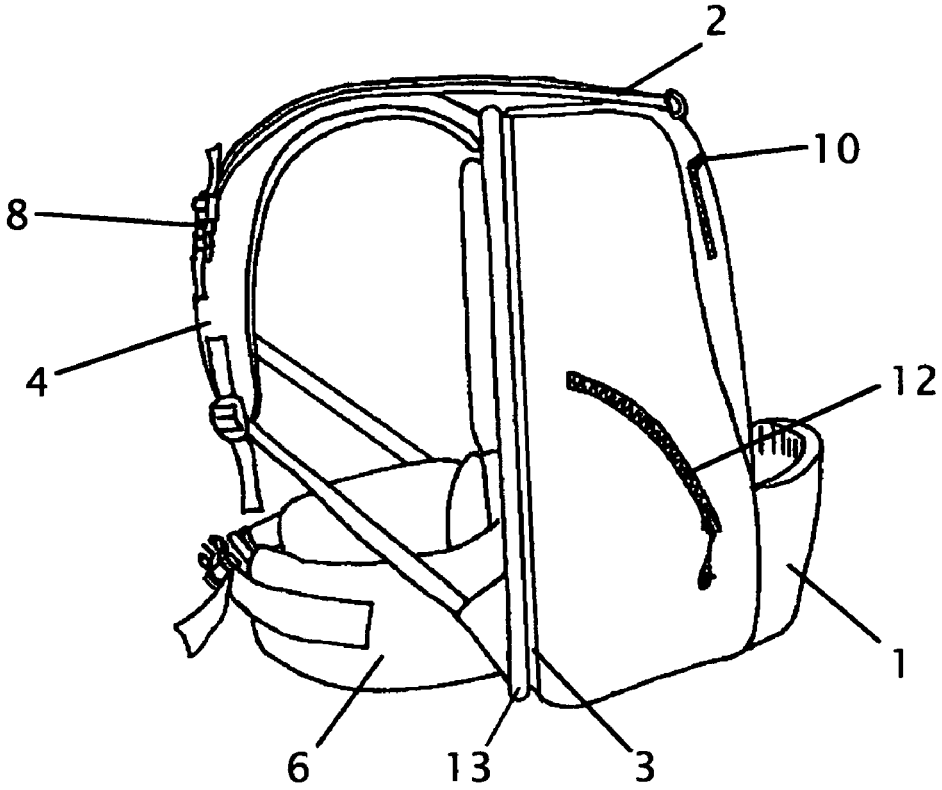
FIG. 7 is a left profile view of an alternative embodiment of the invention.

In accordance with the present preferred embodiment of the invention, a backpack is provided, which is similar in styling to other backpacks designed for outdoor use, which is durable, and which has components incorporated into its structure that make it suitable for the carriage of a weapon such as a long gun firearm or an archery bow. As shown in FIG. 1, it is similar in appearance to conventional backpacks of the prior art, with the exception that a receptacle 1, in the form of an open-topped pocket, and a tether strap 2 are added. In particular, the backpack of the present preferred embodiment of the invention includes a main panel 3 as shown in FIGS. 5, 6, and 7, this being generally elongate in shape, with a front side, a back side, two edges, a top, and a bottom, and which is padded in the areas in which it will contact a wearer's back, such padding being well known and commonly used in the prior art. Two shoulder straps 4 are provided, which in a preferred embodiment are padded such as is common with prior art backpacks designed for carriage of heavier loads. These may be provided with an adjustable chest strap 5, which also is a feature common to load bearing backpacks of the prior art and facilitates lateral adjustment of said shoulder straps.

As is common with load bearing backpacks in the prior art, a waist belt 6 is provided in order to transfer a portion of the load of the backpack to the user's hips. This waist belt is similar to the best waist belts available to the art, with a sandwich construction of heavy nylon or like fabric which is foam filled, and ideally should be wider nearest the main panel of the backpack, and should taper as it extends forward around the wearer's hips or waist, toward a releasable and adjustable clasp, which again is common to the art.

The storage containers of the invention are of two varieties. First, a receptacle 1 is provided, the orientation of which is best seen in FIGS. 1, 5, 6, and 7. This receptacle is a pocket with an open top. It is a receptacle for one end of a long gun firearm 17 or of an archery bow 19 shown in FIG. 3, and is the first component of the weapon carrying device of this invention. The dimensions of this receptacle can be generous, in order to provide for the carriage of the widest possible variety of weapons, or it can be minimally proportioned in order to provide a tailored receptacle to fit a specific object. In the present preferred embodiment, the receptacle has a tapered, funnel shape, so that wider objects such as the end of a compound archery bow will be cradled in the upper portion of it, and narrower objects such as the butt of a long gun firearm will settle further down inside of the funnel shape, to eventually be wedged therein. The receptacle can be constructed of many suitable materials that are known to the prior art of backpacks, such as nylon fabric or molded plastic, and in the preferred embodiment is fixedly attached to the outer aft side of the main cargo compartment of the backpack. In an alternative embodiment, this receptacle may be removably attached in the same location, using a system of standard releasable clips, or zippers, or the like. In an ideal embodiment, the receptacle will have some reinforcing and firming elements built into it, such that it tends to maintain its form and stands away from the structure that it is mounted upon. It preferably should be of a semi-rigid, yet still pliable construction. This can be achieved by making each of its panels of two layers of a heavy-duty nylon fabric, with a thin layer of closed-cell foam sandwiched between the layers. On one or more panels, preferably the narrower side panels, additional stiffness may be achieved by inserting a plastic batten between the nylon layers, or by sewing heavy nylon webbing to the outer layer.

Figure 3:
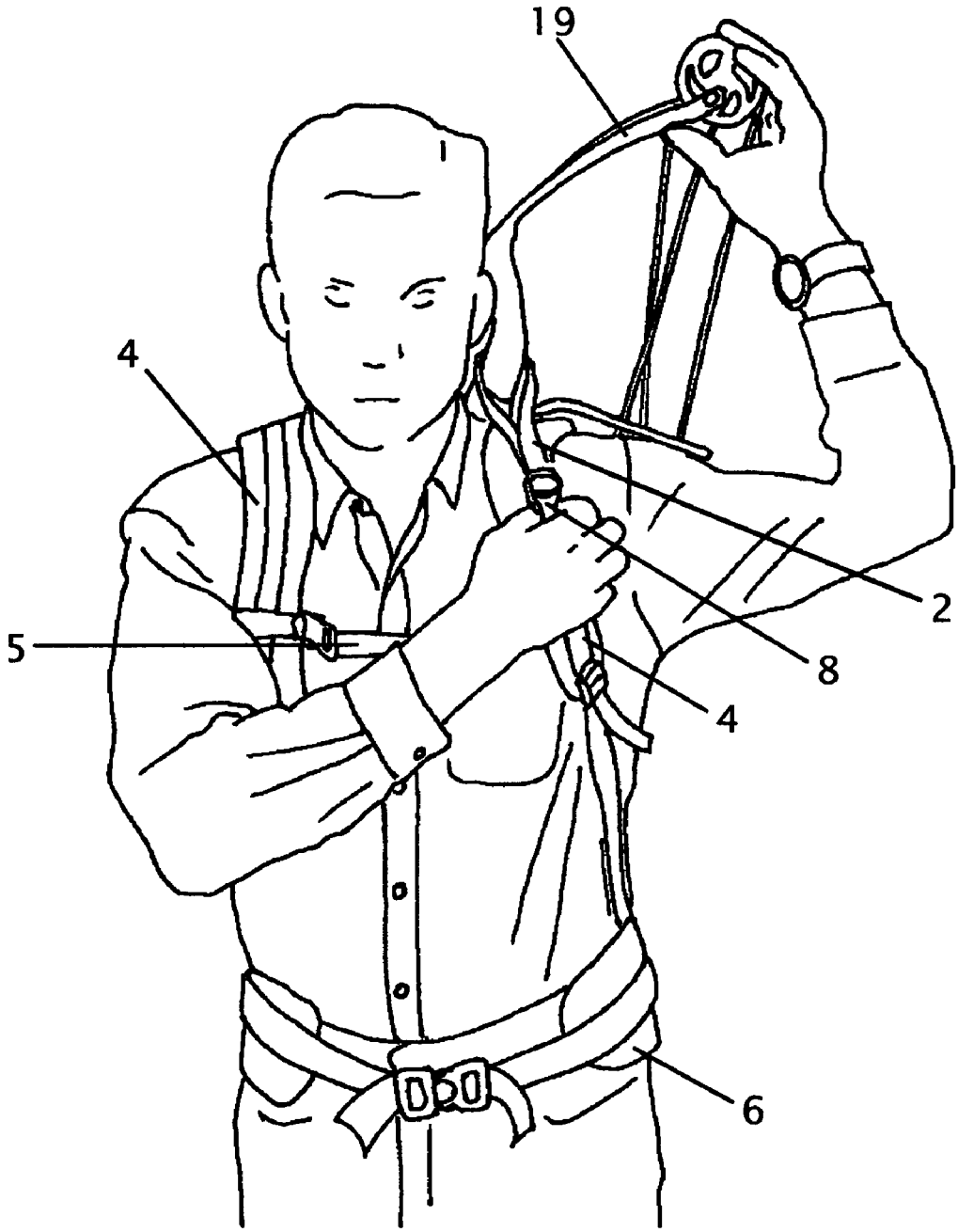
FIG. 3 is a frontal view of the invention, showing a user removing an archery bow.
Figure 4:
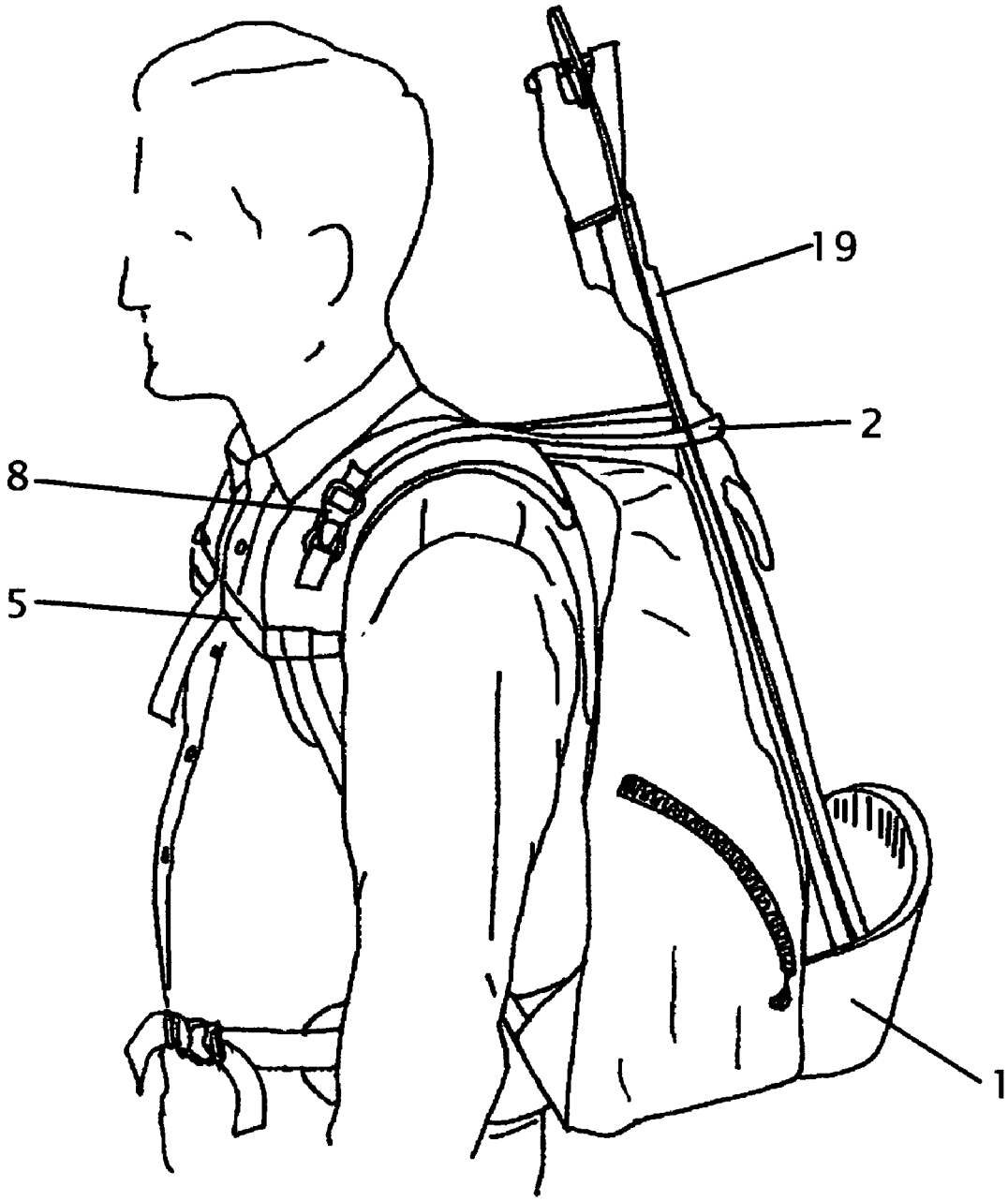
FIG. 4 is a left profile view of the invention, being worn by a user and carrying an archery bow.

The second component of the weapon carrying device of this invention is, in the preferred embodiment, a tether 2 that forms a releasably closed loop. The tether is made from a length of ¾"-wide nylon webbing. Rope, cordage, or cable can similarly be used. One end of the tether is ideally attached to a backpack shoulder strap 4, and the other end is fitted with a releasable buckle assembly 8 or similar components, such that in order to attach a weapon to the backpack, the buckle is released, then the tether is looped around the upper portion of the weapon, then the end with the buckle is brought back to its corresponding fitting on the forward side of the backpack, and reattached. Thereby, in combination with the cradling action of the receptacle 1, the tether will releasably hold an archery bow 19 or firearm 17 to the backpack as seen in FIGS. 1, 2, 3, and 4. This buckle is ideally located on a shoulder strap 4 of the backpack, and can be near the point of attachment to the shoulder strap of the one end of the tether, such that it can be grasped and released with one hand while the backpack is being worn by the user. As seen in FIG. 5, good results are gotten using a buckle that has two components, these being a male component 11 and a female component 14 that releasably lock together when the male is inserted into the female. One component is attached to a shoulder strap 4, and the other is attached to the tether, such that the releasably closed loop that the tether forms is effectively linked to the shoulder strap. Other components that have the equivalent result of forming a releasably closed loop can be used. Alternatively, the tether can comprise a hook that engages a catch on the backpack to form releasable attachment between the tether and the backpack. Similarly, the tether can comprise a loop that engages a catch on the backpack. An auxiliary loophole 22 best seen in FIG. 6 serves the functions of keeping the tether stowed neatly when a weapon is not being carried on the backpack, and also helps to control the lateral movement of a weapon that is being carried. This loophole can be made of a plastic D-ring or alternatively of a strip of nylon webbing sewn to form an orifice for the passage of the tether. FIG. 4 demonstrates that the invention will carry a weapon without the necessary involvement of the user's hands.

Figure 8:
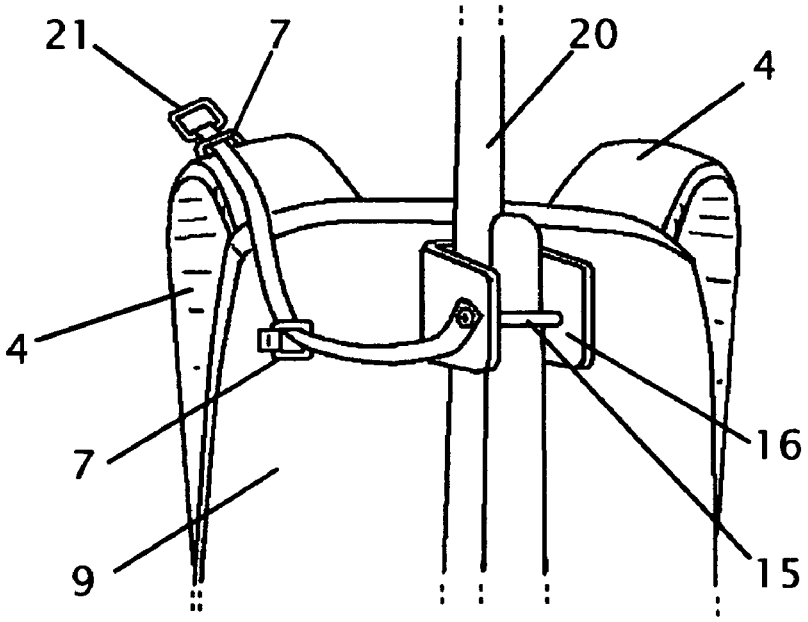
FIG. 8 is a partial view of the aft side of an alternative embodiment of the invention, showing a detail of a pin and housing holding a weapon to the backpack.

In an alternative form as shown in FIG. 8, the tether can be devised such that it is a single-directional link that has a release function similar to a parachute ripcord. In the application of holding, and then releasing, a weapon from its carriage, the ripcord tether would be pulled from an end 21 on the front side of the backpack, and release a pin 15 from a housing 16 on the aft side of the backpack, this housing being configured to accommodate the upper end of the weapon 20 being carried. Prior to disengagement, the pin holds the weapon in the housing, and in combination with the previously described receptacle 1 holds the weapon to the backpack. When the tether pulls the pin from the housing, the weapon is freed from the backpack and is pulled free as elsewhere described in this disclosure. Auxiliary routing loopholes 7, readily made with plastic D-rings, may be used to control the direction of travel in the pulling action of the ripcord, for ease of use, and to align the axis of pull with the direction of travel of the pin in order to provide a consistent release function. This alternative embodiment achieves the same function as the preferred embodiment, which is that of releasably holding the upper part of a weapon to the backpack, and is therefore considered to be the same invention.

The second variety of storage container is made of nylon fabric or like material, is generally six sided, and sewn together to form an interior volume of space in a fashion that is common to the prior art. In a preferred embodiment, this container, forming the majority of the volume of the backpack, will be further subdivided into a number of internal cells of varying sizes, in order to provide a dedicated internal storage space for various items. These storage spaces, devised for the purpose of carrying sundry cargo, will each have at least one aperture with a selectively releasable closure. The present preferred embodiment discloses a larger storage container 9, best seen in FIG. 1, which is similar to storage containers common to the prior art, and ideally is constructed of nylon fabric or like material. It includes an upper zippered opening 10 for accessing the main internal cargo space, plus a zippered aperture 12 for access to the lower regions of the container.

As shown in FIG. 7, it may be desirable to provide an intervening structure 13 between the shoulder straps 4 and the main panel 3 of the backpack. This structure can serve to add additional stiffness and overall strength to the backpack, and would generally have similar construction to standard external frames of aluminum tubing, or plastic, or the like, which are common to the prior art.

Figure 2:
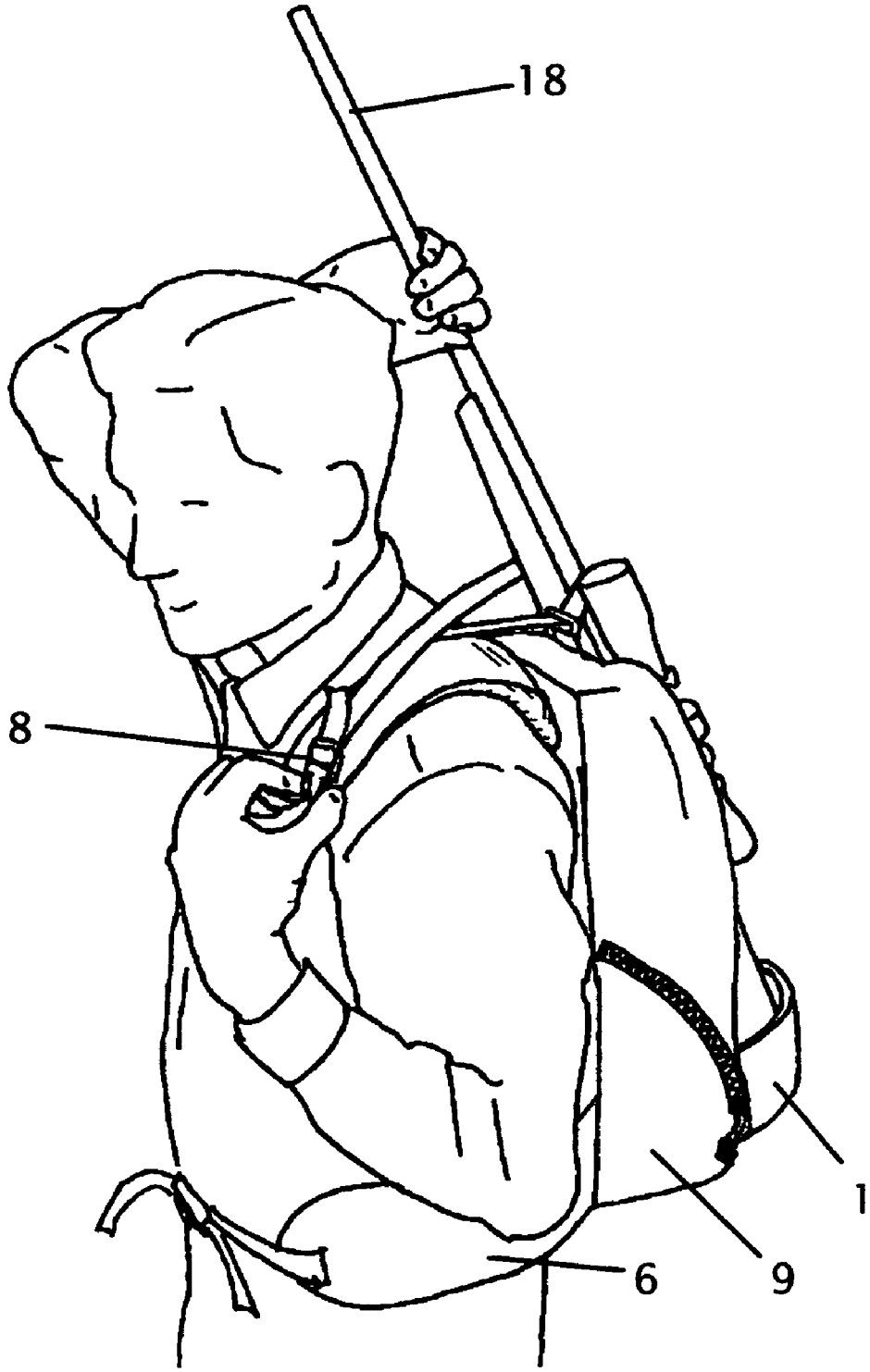
FIG. 2 is a left front quarter perspective view of a user wearing a preferred embodiment of the invention, and releasing a long gun firearm from the invention.

Now referring to FIGS. 1 and 2, a long gun firearm 17 is removed from the weapon carrying device of the preferred embodiment by grasping the barrel 18 or other accessible part with one hand, and grasping the releasable buckle 8 with the other hand. When the latter hand releases the buckle, the firearm is pulled from the receptacle 1 of the weapon carrying device, and is then moved free of the backpack. As seen in FIG. 3, an archery bow 19 is likewise grasped at an upward portion thereof, to be similarly pulled free of the backpack.

The illustrations and the present descriptions of the invention are illustrative only, for purposes of explaining and disclosing the invention. It is here noted that the primary components of the invention, which are the releasable tether and the receptacle in the form of a pocket with an open top, are transferable to other structures which accomplish the same functions, and that storage compartments 9 are an optional component of the backpack. Since numerous modifications and changes will readily occur to those skilled in the art, it is not desired to limit the invention to the exact construction shown and described, and accordingly all modifications and equivalents may be regarded as falling within the scope of the invention. Other forms that employ the present invention and serve the purposes described herein are meant to be encompassed by this disclosure.

I claim:

1. A backpack comprising, in combination:

a main panel, generally elongate in shape, having a top, a bottom, two side edges, a front side, and a back side;

a left and a right shoulder strap, each vertically oriented, wherein said shoulder straps each comprises a first end and a second end and a front facing portion configured to lie on a user's front side of his body when worn, and a backward facing portion configured to lie on a user's back side when worn, wherein said first end of said shoulder straps are attached proximal the top of said main panel, wherein said second end of said shoulder straps are attached proximal the bottom of said main panel, such that said straps can be used to support said main panel, and any attachments thereto, when the straps are worn over the shoulders of a wearer;

a storage container attached to said main panel, said storage container comprising at least a top side, left and right sides, a bottom side, and a rear side facing away from said main panel, said storage container for carrying cargo;

a receptacle attached on the rear side of said storage container facing away from the wearer, said receptacle attached along three sides of said receptacle, having an open top for the insertion and extraction of an archery bow or a long gun firearm, and having an interior space sized suitably for the emplacement therein of one end of an archery bow or a long gun firearm, and configured for release of said archery bow or long gun firearm when said bow or gun is pulled toward said storage compartment top side, and for containing said bow or long gun solely by gravity, to allow unobstructed removal;

a tether with a first end attached to one of the shoulder straps and of sufficient length to reach past said rear side of said storage container be routed aft of said main panel, thence to loop around a portion of an archery bow or a long gun firearm that is being carried on the backpack, thence to return forward to releasably fasten a second end of said tether to a front facing portion of the shoulder strap to which the first end is attached, such that the second end of the tether is accessible by the wearer of the backpack;

and a connecting element located on the backpack that connects an intermediate portion of the tether to the backpack to guide the tether;

wherein said receptacle and said tether are configured such that when a bow or long gun is positioned in said receptacle and said tether is looped around a portion of an archery bow or a long gun firearm, the archery bow or long gun firearm are secured to said backpack; and wherein said receptacle and said tether are configured such that when said tether is released using said attachable and releasable engagement, the wearer of said backpack can remove the archery bow or long gun firearm by reaching over the wearer's shoulder, grasping the long gun or archery bow, and pulling the long gun or archery bow free of the backpack over said wearer's shoulder while the wearer is wearing the backpack.

2. The backpack of claim 1 wherein the first end of said tether is fixedly attached to a shoulder strap.

3. The backpack of claim 1 wherein said second end of the tether is returned forward to a releasable clip attachment proximal the first end of the tether.

4. The backpack of claim 1 wherein the releasable engagement of the tether is comprised of a hook that engages a catch on the backpack.

5. The backpack of claim 1 wherein the releasable engagement of the tether is comprised of a loop that engages a catch on the backpack.

6. The backpack of claim 1 wherein one end of the tether is attached proximal the top of said main panel.

7. The backpack of claim 1 wherein said backpack further comprises an external rigid frame intervening between said described main panel and said shoulder straps, wherein said frame is either fixedly or removably attached to said main panel and said shoulder straps.

8. The backpack of claim 1 wherein said external rigid frame is constructed from material selected from the group consisting of aluminum and plastic.

9. The backpack of claim 1 in which said receptacle is semi rigid and configured to keep the top portion of said receptacle in an open position.

10. The backpack of claim 1 in which said receptacle is removably attached to said storage container of said backpack.

11. The backpack of claim 1 in which said receptacle is a generally tapered funnel shape and semirigid or rigid so that the open end of said receptacle remains open when said bow or long gun is removed.

12. A backpack comprising, in combination:

a main panel, generally elongate in shape, having a top, a bottom, two side edges, a front side, and a back side;

a left and a right shoulder strap, each vertically oriented, wherein said shoulder straps each comprises a first end and a second end and a front facing portion configured to lie on a user's front side of his body when worn, and a backward facing portion configured to lie on a user's back side when worn, wherein said first end of said shoulder straps are attached proximal the top of said main panel, wherein said second end of said shoulder straps are attached proximal the bottom of said main panel, such that said straps can be used to support said main panel, and any attachments thereto, when the straps are worn over the shoulders of a wearer;

a storage container attached to said main panel, said storage container comprising at least a top side, left and right sides, a bottom side, and a rear side facing away from said main panel, said storage container for carrying cargo;

a semi rigid receptacle attached on the rear side of said storage container facing away from the wearer, said receptacle attached along three sides of said receptacle, having an open top for the insertion and extraction of an archery bow or a long gun firearm, with said open top remaining open by said semi rigid nature of said receptacle, and having an interior space sized suitably for the emplacement therein of one end of an archery bow or a long gun firearm, and configured for release of said archery bow or long gun firearm when said bow or gun is pulled toward said storage compartment top side, and for containing said bow or long gun solely by gravity, to allow unobstructed removal;

a tether with a first end attached to one of the shoulder straps and of sufficient length to reach past said rear side of said storage container, thence to loop around a portion of an archery bow or a long gun firearm that is being carried on the backpack, thence to return forward to releasably fasten a second end of said tether to a front facing portion of the shoulder strap to which the first end is attached, such that the second end of the tether is accessible by the wearer of the backpack;

and a connecting element located on the backpack that connects an intermediate portion of the tether to the backpack to guide the tether;

wherein said receptacle and said tether are configured such that when a bow or long gun is positioned in said receptacle and said tether is looped around a portion of an archery bow or a long gun firearm, the archery bow or long gun firearm are secured to said backpack; and wherein said receptacle and said tether are configured such that when said tether is released using said attachable and releasable engagement, the wearer of said backpack can remove the archery bow or long gun firearm by reaching over the wearer's shoulder, grasping the long gun or archery bow, and pulling the long gun or archery bow free of the backpack while the wearer is wearing the backpack.

13. The backpack of claim 12 in which said receptacle is removably attached to said storage container of said backpack.

14. The backpack of claim 12 in which said receptacle is a generally tapered funnel shape and semirigid or rigid so that the open end of said receptacle remains open when said bow or long gun is removed.

* * * * *